US008998039B2

(12) United States Patent
Kimura et al.

(10) Patent No.: US 8,998,039 B2
(45) Date of Patent: Apr. 7, 2015

(54) CAULKING GUNS

(71) Applicant: Makita Corporation, Anjo-shi, Aichi (JP)

(72) Inventors: Kazuya Kimura, Anjo (JP); Tomoyuki Kondo, Anjo (JP)

(73) Assignee: Makita Corporation, Anjo-Shi (JP)

( * ) Notice: Subject to any disclaimer, the term of this patent is extended or adjusted under 35 U.S.C. 154(b) by 45 days.

(21) Appl. No.: 13/772,988

(22) Filed: Feb. 21, 2013

(65) Prior Publication Data

US 2013/0233892 A1 Sep. 12, 2013

(30) Foreign Application Priority Data

Mar. 8, 2012 (JP) ..... 2012-051434
Jun. 26, 2012 (JP) ..... 2012-142856

(51) Int. Cl.
*B05C 17/01* (2006.01)
*B65D 83/00* (2006.01)

(52) U.S. Cl.
CPC ..... *B65D 83/0033* (2013.01); *B05C 17/0103* (2013.01); *B05C 17/014* (2013.01); *B05C 17/0116* (2013.01)

(58) Field of Classification Search
CPC ..... B05C 17/0103; B05C 17/014
USPC ..... 222/333, 390, 327; 192/45.006
See application file for complete search history.

(56) References Cited

U.S. PATENT DOCUMENTS

| | | | | | |
|---|---|---|---|---|---|
| 2,028,512 | A * | 1/1936 | Maier | 192/48.3 |
| 2,369,848 | A * | 2/1945 | Patterson | 192/45.006 |
| 3,491,919 | A * | 1/1970 | Ramsay | 222/309 |
| 4,024,994 | A | 5/1977 | Davis, Jr. | |
| 4,171,072 | A | 10/1979 | Davis, Jr. | |
| 4,615,469 | A | 10/1986 | Kishi et al. | |
| 4,669,636 | A * | 6/1987 | Miyata | 222/153.01 |
| 5,429,512 | A * | 7/1995 | Sawamura | 439/97 |
| 5,450,988 | A * | 9/1995 | Jerdee | 222/333 |
| 5,480,102 | A * | 1/1996 | Sato | 242/310 |
| 5,653,363 | A * | 8/1997 | Chang | 222/391 |
| 5,775,539 | A * | 7/1998 | Bates et al. | 222/1 |
| 5,788,126 | A * | 8/1998 | Chang | 222/391 |
| 7,420,341 | B2 * | 9/2008 | Glasgow et al. | 318/280 |
| 8,740,021 | B2 * | 6/2014 | Naughton et al. | 222/333 |
| 2002/0005325 | A1 * | 1/2002 | Yamada | 192/38 |
| 2010/0006605 | A1 * | 1/2010 | Sung et al. | 222/327 |
| 2012/0118917 | A1 * | 5/2012 | Naughton et al. | 222/333 |

FOREIGN PATENT DOCUMENTS

| | | |
|---|---|---|
| DE | 34 18 052 A1 | 12/1984 |
| JP | A-58-137465 | 8/1983 |
| JP | A-59-222251 | 12/1984 |
| JP | A-6-47328 | 2/1994 |
| JP | A-8-257465 | 10/1996 |
| JP | B2-3598565 | 12/2004 |

OTHER PUBLICATIONS

Extended European Search Report issued in European Patent Application No. 13156732.3 dated Aug. 6, 2013.

* cited by examiner

*Primary Examiner* — Daniel R Shearer
(74) *Attorney, Agent, or Firm* — Oliff PLC

(57) ABSTRACT

An electric caulking gun may include a cartridge setting portion to which a cartridge containing a caulking material can be set, an electric motor, a push rod driven by the electric motor via a power transmission path and configured to be pressed against the cartridge for dispensing the caulking material from the cartridge, and an interruption device provided in the power transmission path and operable for interrupting the power transmission path and allowing the push rod to be freely moved.

9 Claims, 8 Drawing Sheets

CAULKING GUNS

This application claims priority to Japanese patent application serial numbers 2012-051434 and 2012-142856, the contents of which are incorporated herein by reference.

BACKGROUND OF THE INVENTION

1. Field of the Invention

This invention relates to filling tools (so-called caulking guns) used mainly for repairing operations of building materials or the like for the purpose of waterproofing, such as repairing operations of cracks or gaps in the outer wall of a residential building and repairing operations of a joint between a bathtub and a wall surface of a bathroom, by filling materials, such as a silicon type filling material, (hereinafter simply referred to as caulking materials).

2. Description of the Related Art

For example, a caulking material known as a silicon sealant is commercially available on the market in a form of a cartridge filled with a fixed amount of the material. The cartridge may be set in a dedicated caulking gun to be used for the filling operation.

In general, the caulking gun includes a lever in the form of a trigger that can be pulled by the user grasping a handle portion of the caulking gun to move an push rod, whereby the caulking material can be extruded from a nozzle of the cartridge. In the case of this completely manual type caulking gun, great fatigue is involved as a result of the repetition of the extruding operation. In view of this there has been provided an electric caulking gun using an electric motor as a drive source. Techniques related to this electric caulking gun are disclosed, for example, in JP-A-8-257465 (also published as Japanese Patent No. 3598565), JP-A-58-137465, and U.S. Pat. No. 4,615,469 (Also published as JP-A-59-222251). In the electric caulking guns as disclosed in these publications, the electric motor is started to move the push rod when a switch lever is operated to be turned on. Therefore, unlike the manual type caulking gun, in which the operation force of the lever generates the extrusion force, the user can easily perform the filling operation repeatedly.

However, the electric caulking guns potentially involve a problem of so-called after-dripping, in which some caulking material is discharged due to the residual pressure inside the cartridge immediately after the stopping of the electric motor. JP-A-8-257465 discloses a technique for inhibiting the problem of after-dripping. According to an after-dripping prevention mechanism disclosed in this publication, the electric motor is reversed immediately after the of operation, so that the push rod is forcibly restored to thereby release the residual pressure inside the cartridge, whereby it is possible to prevent after-dripping.

However, because the electric motor is reversed to forcibly restore the push rod in the case of this after-dripping prevention mechanism, a gap may be generated between the rear end surface of the cartridge (the surface to be pressed by the push rod) and the front end of the push rod. Thus, when the electric motor is started again, the push rod moves idle by an amount corresponding to this gap before being pressed against the rear end surface of the cartridge, with the result that there is generated a time lag (a delay) by an amount corresponding to this idle movement (i.e., corresponding to the gap).

Therefore, there has been a need in the art for a technique of inhibiting the after-dripping without causing a time lag in pressing a cartridge by a push rod.

SUMMARY OF THE INVENTION

In one aspect according to the present teachings, an electric caulking gun may include a cartridge setting portion to which a cartridge containing a caulking material can be set, an electric motor, a push rod driven by the electric motor via a power transmission path and configured to be pressed against the cartridge for dispensing the caulking material from the cartridge, and an interruption device provided in the power transmission path and operable for interrupting the power transmission path and allowing the push rod to be freely moved.

DETAILED DESCRIPTION OF THE INVENTION

Figure 1:
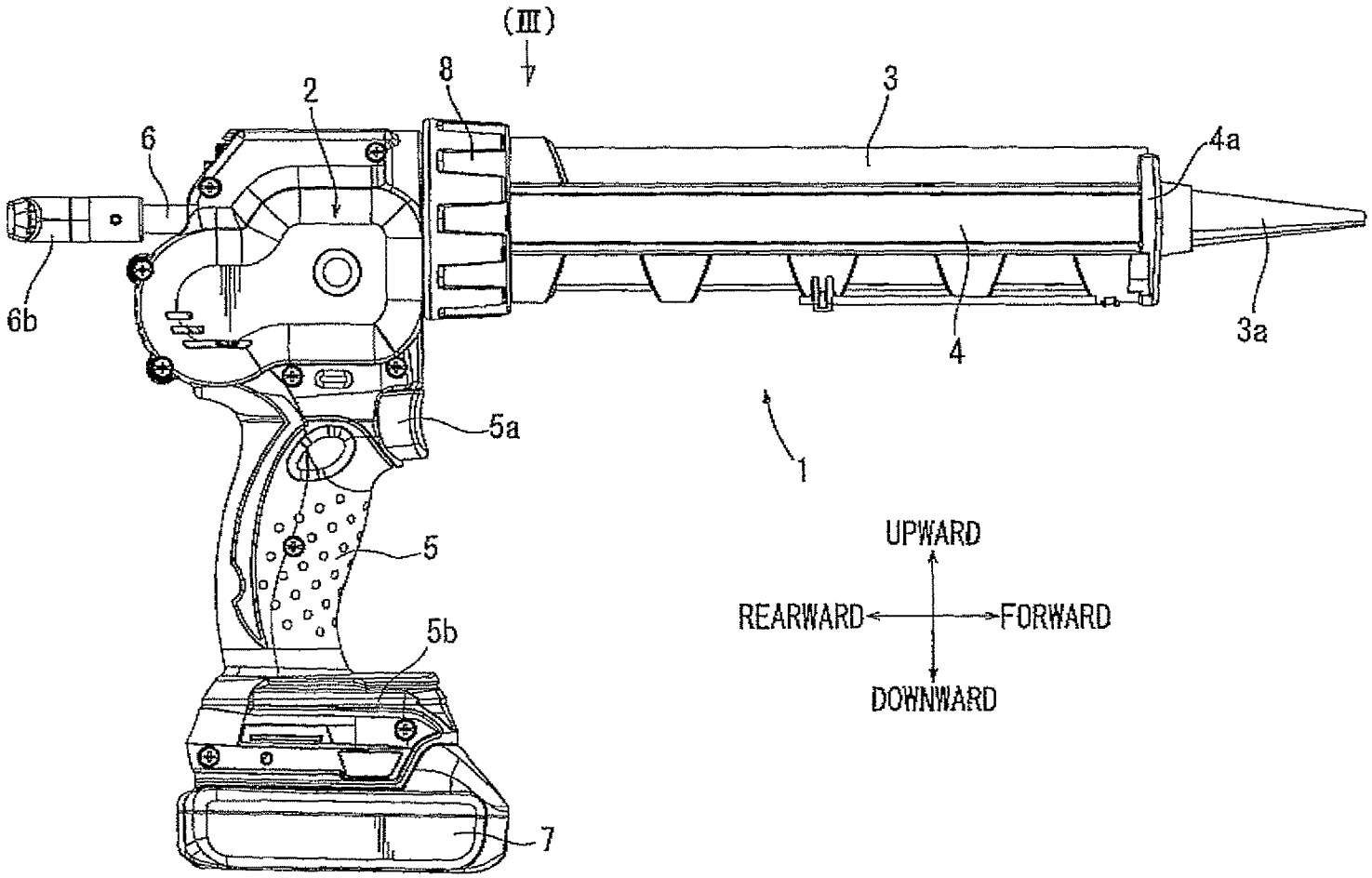
FIG. 1 is a side view of a caulking gun according to a representative embodiment showing a cartridge set in the caulking gun.

Each of the additional features and teachings disclosed above and below may be utilized separately or in conjunction with other features and teachings to provide improved caulking guns. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one embodiment, an electric caulking gun may include a cartridge setting portion to which a cartridge containing a caulking material can be set, an electric motor, a push rod driven by the electric motor via a power transmission path and configured to be pressed against the cartridge set at the cartridge setting portion to cause the caulking material to be dispensed from the cartridge, and a transmission state switching device provided in the power transmission path. The transmission state switching device may switch between a power transmission state in which the power transmission path is connected to transmit the power of the electric motor to the push rod, and a transmission interruption state in which the power transmission path is interrupted to permit the push rod to make a free movement independently of the rotation of the electric motor.

With this arrangement, when the transmission state switching device is switched to the transmission interruption state, the push rod is separated from the power transmission path of the electric motor. Therefore, the push rod is allowed to make a free movement independent of the power of the electric motor with respect to both the advancing and retreating directions. When the push rod is placed in the state allowing free movement, it may retreat together with the extrusion surface of the cartridge due to the residual pressure inside the cartridge, whereby the residual pressure inside the cartridge is released. Hence, it is possible to prevent after-dripping.

In this way, the push rod is separated from the power transmission path of the electric motor to be placed in a state in which it is freely movable, and the push rod retreats together with the extrusion surface of the cartridge as a result of the releasing of the residual pressure, so that no gap is generated between the extrusion surface of the cartridge and the distal, end of the push rod. Therefore, over-restoration of the push rod cased by being forcibly retracted to an excessive degree through the reversing of the electric motor as in the related art, may not be caused, so that there is generated no time lag corresponding to the gap at the time of the next extrusion.

The transmission state switching device may switch from the power transmission state to the transmission interruption state when the rotation of the electric motor is reversed. Therefore, the push rod is placed in the state in which it can move freely. Thereafter, the residual pressure inside the cartridge may push the push rod back. This means the push rod is not directly retracted by the reverse rotation the electric motor. Hence, over (i.e., production of a gap between the extrusion surface of the cartridge and the front end of the push rod) as in the related art may not be caused, and it is possible to avoid a time lag at the time of the next extrusion while preventing after-dripping.

The transmission state switching device may include an upstream side transmission member provided on an upstream side in the power transmission path and having an outer circumferential surface with a plurality of flat transmission switching surfaces, a downstream side transmission member provided on a downstream side in the power transmission path and having an inner circumferential surface with a circular power transmission surface, and a plurality of power transmission pins each provided between each flat transmission switching surface and the circular power transmission surface. A distance between the power transmission surface and each transmission switching surface may change through relative displacement in a rotational direction of the upstream side transmission member with respect to the downstream side transmission member to switch between the power transmission state, in which each power transmission pin is clamped between the power transmission surface and each transmission switching surface, and the transmission interruption state in which the clamping of each power transmission pin is released to interrupt the power transmission path.

With this arrangement, each power transmission pin provided between the transmission switching surface of the upstream side transmission member and each power transmission surface of the downstream side transmission member may be clamped or wedged between these surfaces, whereby the rotational power of the electric motor is transmitted to the push rod, and the caulking material may be dispensed from the cartridge. The clamping state of the power transmission pins may be released, for example, when the electric motor rotates in the reverse direction after it has been stopped. In this way, the power transmission state in which the downstream side transmission member is capable of relative rotation with respect to the upstream side transmission member may be achieved. Eventually, a state in which the push rod can retreat independently of the power of the electric motor (the state in which free movement is possible for the push rod) may be achieved. Therefore, the push rod may be moved to retreat by the residual pressure in the cartridge to release the residual pressure, thereby preventing after-dripping.

In this way, retraction by the power obtained by reversing the electric motor as in the related art is not used. Instead, the push rod is placed in the state in which it is allowed to make free movement due to the switching of the transmission switching device to the power separation state. Then, the extrusion surface of the cartridge retreats due to the residual pressure therein, with the result that the extrusion surface retreats together with the push rod. Thus, no gap is generated between the front end of the push rod and the extrusion surface of the cartridge, so that time lag corresponding to the gap generated in the related art is not generated at the time of the next start of the electric motor. In this way, simultaneously with the next start of the electric motor, the extrusion surface of the cartridge may be pushed to dispense the caulking material, so that it is possible to improve the caulking gun in terms of usability and to realize a quick caulking material applying operation.

Further, the transmission state switching device is switched between the power transmission state and the transmission interruption state through clamping (wedging) and releasing of the power transmission pins through relative rotation between the transmission switching surfaces and the power transmission surface. Therefore, as compared with the case where there is employed an engagement teeth type (cam type) clutch in which switching is effected between a power transmission state and a transmission interruption state through, for example, engagement and disengagement of engagement teeth, it is possible to effect switching between the power transmission state and the transmission interruption state in a shorter time. As a result, it is possible to shorten the time (i.e., the time lag) that elapses from the turning-on of the switch until the push rod starts to advance, which also helps to improve the caulking gun in terms of responsiveness.

In one example, when the rotation of the electric motor is reversed, the transmission state switching device may be switched to the transmission interruption state to release the clamping of each power transmission pin, so that the reverse rotation of the electric motor is interrupted by the transmission state switching device.

In this way, the transmission state switching device may function as a one-way clutch. At the time of normal rotation of the electric motor, the transmission state switching device may be switched to the power transmission state to transmit the rotational power to the push rod. On the other hand, when the electric motor is reversed, the transmission state switching device may be switched to the transmission interruption state, where the push rod is separated from the power transmission path and allowed to make free movement. Even in the case that the electric motor continues to be rotated in the reverse direction, the rotational power thereof may not be transmitted to the push rod, thus resulting in an idling state. The push rod separated from the power transmission path and placed in the state in which it can make free movement, may be pushed back by the residual pressure in the cartridge. Thus, the push rod is not restored to a degree more than necessary, and the front end thereof is maintained in the state in which it is held in contact with the extrusion surface of the cartridge, so that it is possible to avoid generation of a time lag at the time of the next start while reliably releasing the residual pressure of the cartridge to prevent after-dripping.

The power transmission path may include a rotary member rotatable with the movement of the push rod when the power transmission state switch device is in the transmission interruption state. The caulking gun further include a rotational resistance applying device configured to apply a rotational resistance force to the rotary member.

Thus, in the case that the power state switch device is in the transmission interruption state to allow free movement of the push rod, the rotational resistance applying device may apply the rotational resistance force to the rotary member. Therefore, although the push rod is free to move, an adequate resistance force may be applied to the push rod against its movement. In this way, for example, even in the case that the caulking gun is brought to an upwardly oriented position, the resistance force applied to the push rod may prevent the push rod from accidentally moving downward by the gravity force. Hence, it may be possible to reliably hold the push rod in a state where its front end is in contact with the extrusion surface of the cartridge. As a result, it is possible to further reliably eliminate potential time lag of movement of the push rod at the time of the next extrusion.

Further, because the resistance force is indirectly applied to the push rod via the rotary member, a smaller resistance force against rotation of the rotary member may produce an adequate resistance force against movement of the push rod in comparison with the arrangement where a resistance against movement is directly applied to the push rod 6. As a result, the caulking gun having the rotational resistance applying device can be configured to have a simple and compact construction.

The rotary member to which the resistance force is applied by the resistance force applying device may be the downstream side transmission member.

The rotational resistance force may be a magnetic attracting force. In such a case, the rotational resistance applying device may be a magnet. The magnet can apply an adequate rotational resistance force to the rotary member without leading to a complicated construction of the caulking gun.

Figure 2:
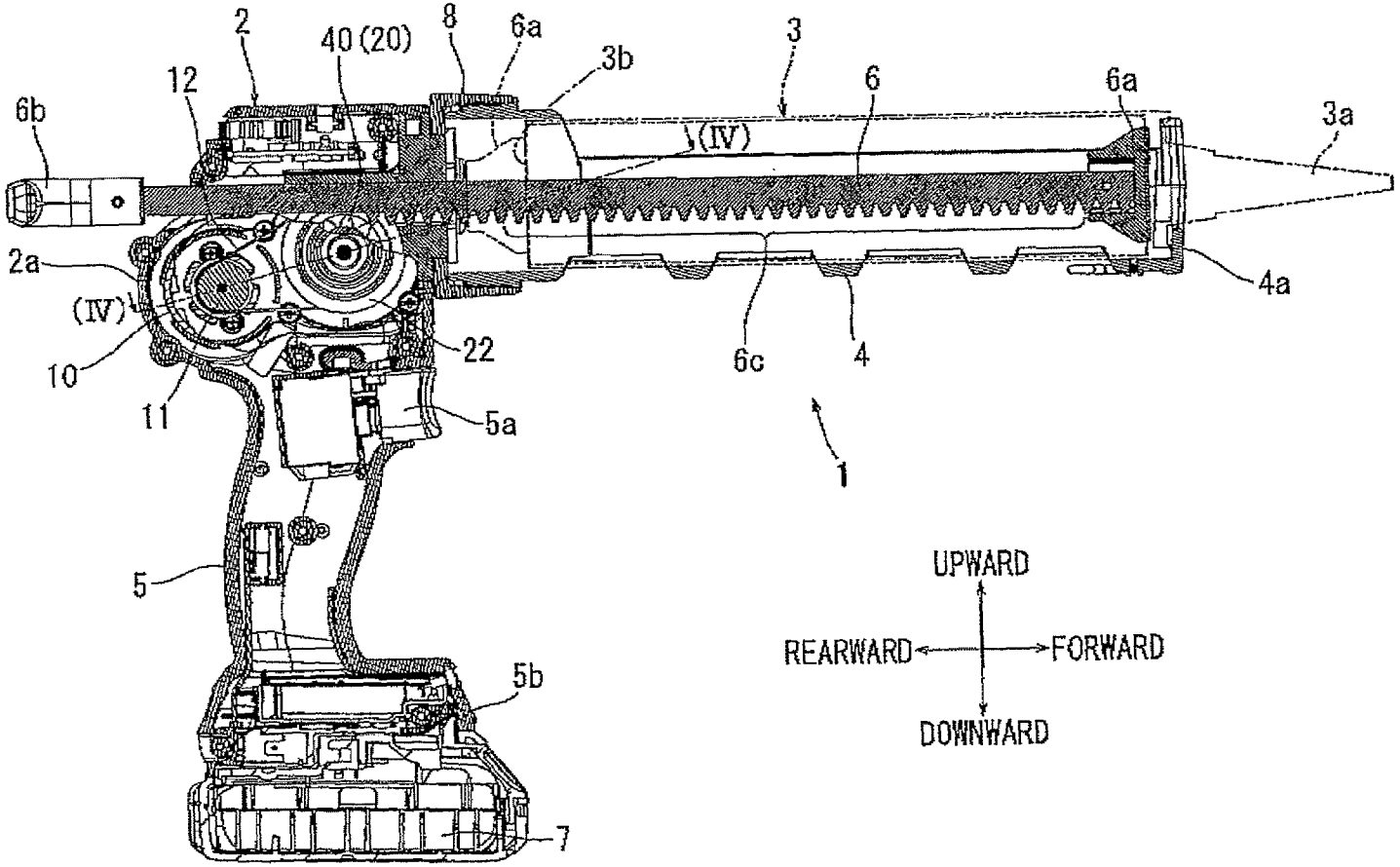
FIG. 2 is a vertical sectional view illustrating the internal structure of the caulking gun.
Figure 3:
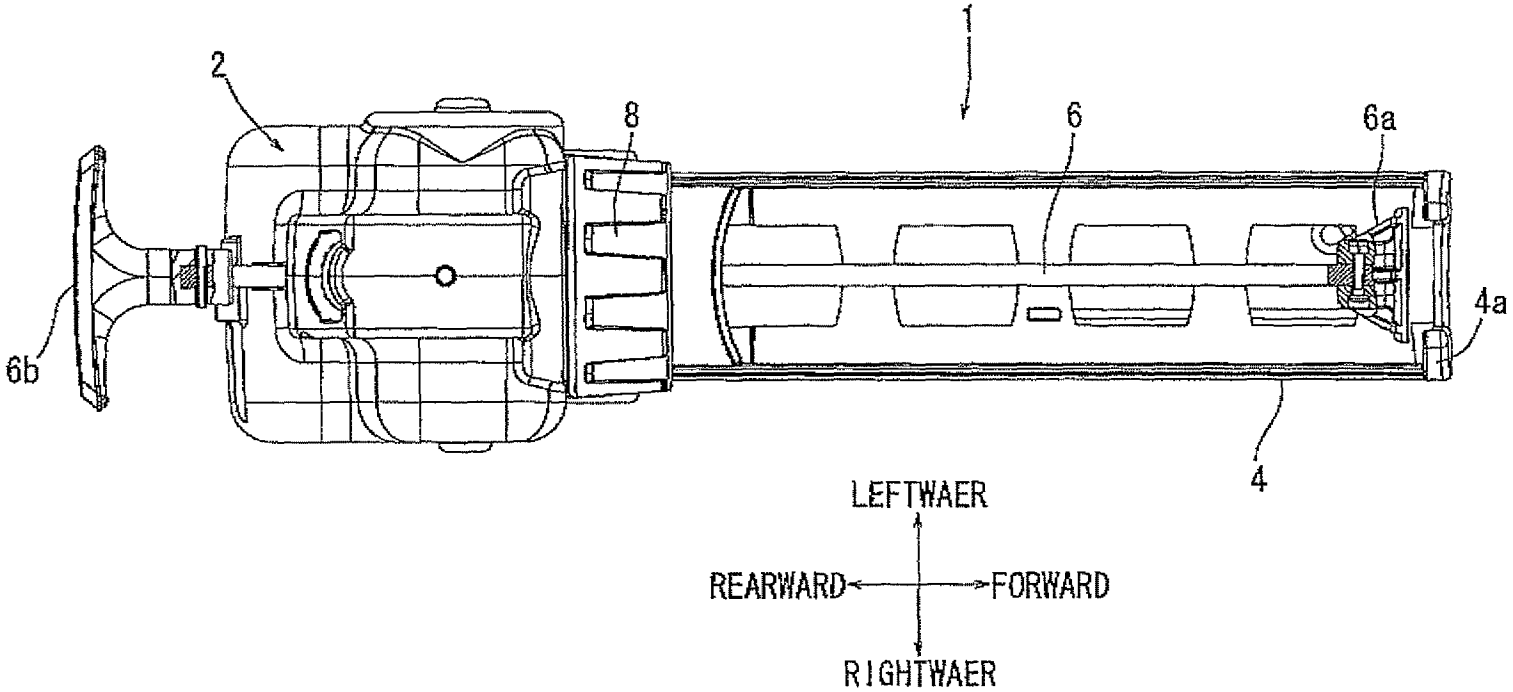
FIG. 3 is a plan view of the caulking gun as viewed in a direction indicated by arrow III in FIG. 1.

An embodiment of the present invention will now be described with reference to FIGS. 1 through 7. FIGS. 1 through 3 show an electric caulking gun 1 according to the present embodiment. The caulking gun 1 may generally include a main body portion 2 having an electric motor 10 disposed therein for serving as a drive source, a cartridge setting portion 4, through which a cartridge 3 accommodating a caulking material can be set, and a handle portion 5 to be grasped by the user.

The cartridge setting portion 4 is disposed at the front portion of the main body portion 2 so as to protrude forward therefrom. The cartridge setting portion 4 may have a semi-cylindrical tubular shape for holding the cartridge 3 from below, so that a nozzle 3*a* of the cartridge 3 may protrude forward from a front end portion 4*a* of the cartridge setting portion 4. The cartridge setting portion 4 can be detached from the main body portion 2 by loosening a threaded fixing sleeve 8.

A push rod 6 may protrude forward from the front portion of the main body portion 2. This push rod 6 is movable in forward and rearward directions within the cartridge setting portion 4. At the front end of this push rod 6, there is provided a push plate 6*a* to be pressed against an extrusion surface 3*b* of the cartridge 3. Referring to FIG. 2, the push rod 6 can move between a front stroke end and a rear stroke end, where the push plate 6*a* is positioned as indicated by solid lines and chain double-dashed lines, respectively, as shown in rig 2. The rear end portion of the push rod 6 may protrude rearwards from the main body portion 2. A grip 6*b* may be provided at the rear end portion and can be grasped by the user for pulling the push rod 6. On the lower surface of the push rod 6, there is provided a rack portion 6*c* extending along the longitudinal direction thereof. This rack portion 6*c* may mesh with a drive gear 40 that will be described later, in a power transmission state, the push rod 6 advances via a power transmission mechanism including a rack/pinion mechanism formed by the rack portion 6*c* and the drive gear 40.

The handle portion 5 is provided so as to protrude downwardly from the lower portion of the main body portion 2. On the front side of the base portion of the handle portion 5, there is provided a switch lever 5*a* to be pulled by a fingertip of the hand of the user grasping the handle portion 5. When the switch lever 5*a* is pulled (i.e., turned on), an electric motor 10 provided inside the main body portion 2 starts to rotate in a normal direction. When the pulling operation is released (i.e., turning-off operation is performed), the electric motor 10 stops after being slightly rotated in a reverse direction. A battery attachment portion 5*b* is provided at the lower end portion of the handle portion 5. A battery pack 7 may be attached to the battery attachment portion 5*b*. The electric motor 10 rotates with a supply of power from the battery pack 7. The battery pack 7 may be a rechargeable batter and may be repeatedly used by being detached from the battery attachment portion 5*b* and recharged by a charger separately prepared.

Figure 4:
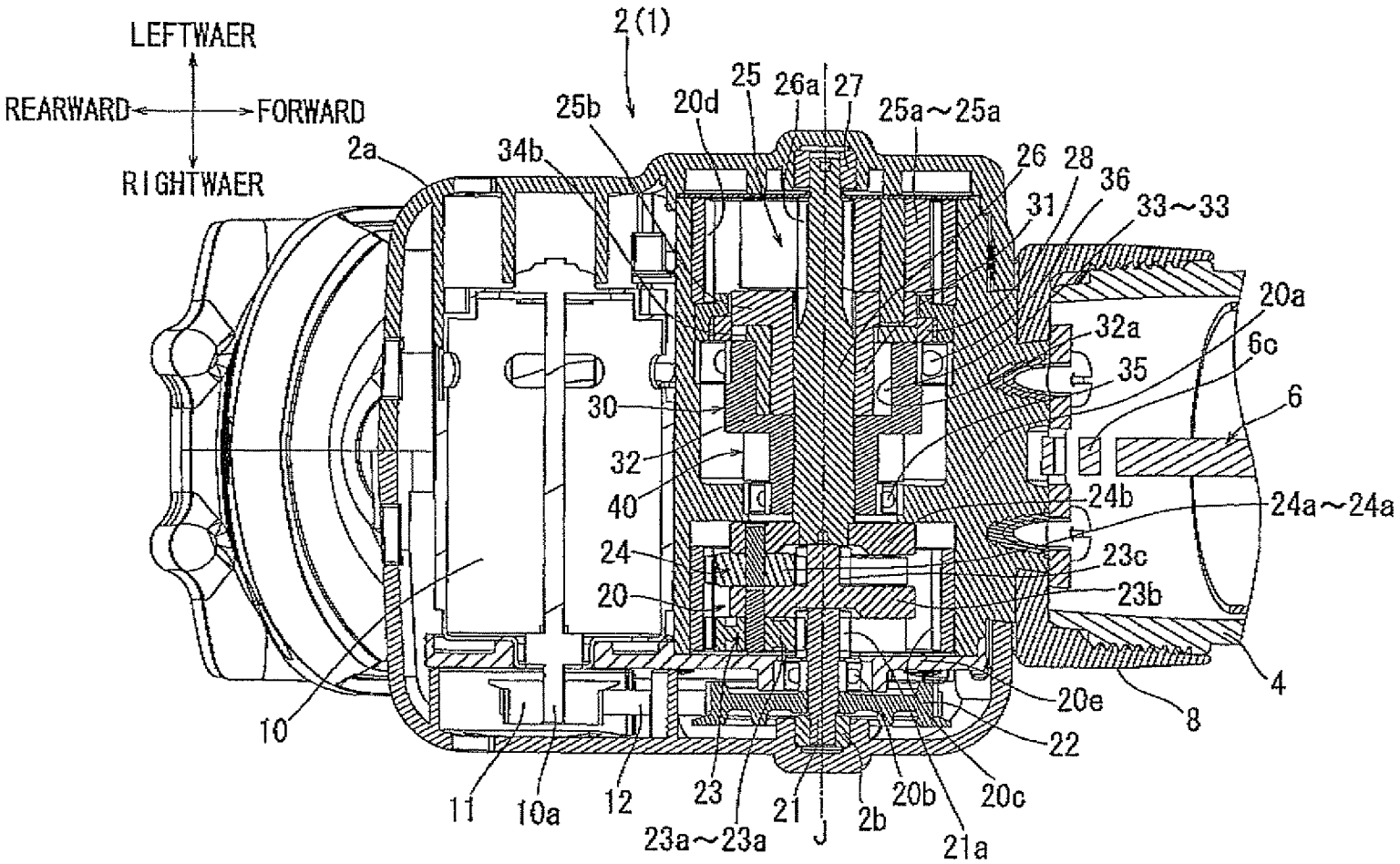
FIG. 4 is a cross-sectional view taken along line IV-IV in FIG. 2 and showing a drive unit.

FIG. 4 shows the internal structure of the main body portion 2. The electric motor 10 may be disposed within a rear portion of a main body housing 2*a* of the main body portion 2. A drive pulley 11 may be mounted to an output shaft 10*a* of the electric motor 10. A reduction gear mechanism 20 is disposed on the front side of the electric motor 10. An input shaft 21 of the reduction gear mechanism 20 is arranged so as to be rotatable about an axis J that may be parallel to the output shaft 10*a* of the electric motor 10. A driven pulley 22 having a larger diameter than the drive pulley 11 may be mounted to the input shaft 21. A transmission belt 12 may extend between the drive pulley 11 and the driven pulley 22. Due to this belt transmission mechanism, the rotational power of the electric motor 10 is reduced at a fixed reduction ratio before being input to the reduction gear mechanism 20.

The reduction gear mechanism 20 may include a first stage planetary gear train 23, a second stage planetary gear train 24, a third stage planetary gear train 25, and a transmission state switching device 30. The input shaft 21 is rotatably supported by the right-hand side portion of a main body housing 2*a* via a bearing 2*b* and is also rotatably supported by the right-hand side portion of a housing cover 20*e* via a bearing 20*b*. On this input shaft 21, there is formed a first-stage sun gear 21*a* of the first-stage planetary gear train 23. Three first-stage planetary gears 23*a* are in mesh with, the first-stage sun gear 21*a*. Each first-stage planetary gear 23*a* is in mesh with a right-band side internal gear 20*c* mounted within the right-hand side portion of a gear housing 20*a*. The three first-stage planetary gears 23*a* are rotatably supported by a first-stage carrier 23*b*. A second-stage sun gear 23*c* of the second-stage planetary gear train 24 is formed on the first-stage carrier 23*b*. The three second-stage planetary gears 24*a* are in mesh with the second-stage sun gear 23*c*. The second-stage planetary gears 24*a* are also in mesh with the above-mentioned right-hand side internal gear 20*c*. The three second-stage planetary gears 24*a* are rotatably supported by a second-stage carrier 24*b*. A drive shaft 26 is connected to the second-stage carrier 24*b*. In this way, the rotational power of the electric motor 10 reduced by the belt transmission mechanism is further reduced by the above-mentioned first-stage and second-stage planetary gear trains 23 and 24 before being transmitted to the drive shaft 26.

The drive shaft 26 is arranged on the same axis as the input shaft 21. Accordingly, the drive shaft 26 is rotatable about the axis J that is parallel to the output shaft 10*a* (rotational axis) of the electric motor 10. The drive shaft 26 extends to the left-hand side portion within the main body portion 2. The left-hand side end portion of the drive shaft 26 is rotatably supported by the main body housing 2*a* via a bearing 27. A third-stage sun gear 26*a* of the third planetary gear train 25 is formed on the left-hand end portion of the drive shaft 26. The three third-stage planetary gears 25*a* are in mesh with the third-stage sun gear 26*a*. Each third-stage planetary gear 25*a* is in mesh with a left-hand side internal gear 20*d* mounted within the left-hand side portion of the gear housing 20*a*. The three third-stage planetary gears 25*a* are rotatably supported by a third-stage carrier 25*b*.

In this way, the rotational power of the drive shaft 26 is further reduced by the third-stage planetary gear train 25 before being input to the transmission state switching device 30. As shown in the drawing, this transmission state switching device 30 is coaxial with the drive shaft 26, and is positioned substantially centrally with respect to the right and left widthwise direction of the main body portion 2. When the drive shaft 26 or the electric motor 10 rotates in a normal direction, the rotational force may be transmitted to the drive gear 40 via the transmission state switching device 30, so that the push rod 6 in mesh with the drive gear 40 moves forward.

Here, the transmission path for the rotational power from the electric motor 10 to the drive gear 40 will be described. First, at the right-hand end portion of the main body portion 2, the rotational power is input to the input shaft 21 via the belt transmission type reduction mechanism. The rotational power input to the input shaft 21 is output to the drive shaft 26 via the first-stage and second-stage gear trains 23 and 24. At the left-hand end portion thereof, the rotational power transmitted to the drive shaft 26 is input to the third-stage planetary gear train 25. Regarding the third-stage planetary gear train 25, the orientation with respect to the right and left direction thereof (the positional relationship of the third-stage carrier 25*b* with respect to the third-stage sun gear 26*a*) is opposite that of the first-stage and second-stage planetary gear trains 23 and 24. The rotational power input to the third-stage planetary gear row 25 is transmitted to the drive gear 40 via the transmission state switching device 30.

In this way, the transmission path of the rotational power of the electric motor 10 input from the right-hand end side of the main body portion 2 is oriented from the right-hand end side of the main body portion 2 to the left-hand end side thereof, and the orientation is then reversed to return to the center with respect to the right and left widthwise direction of the main body portion 2 for transmission to the drive gear 40, thus forming a J-shaped transmission path. With this transmission path for the rotational power, it is possible to arrange a larger number of stages of reduction gear trains (planetary gear train) on the axis J, and to obtain a large reduction ratio while achieving a reduction in the size in the widthwise direction of the main body portion 2. Further, it is possible to arrange the push rod 6 across the center with respect to the widthwise direction of the main body portion 2.

Figure 5:
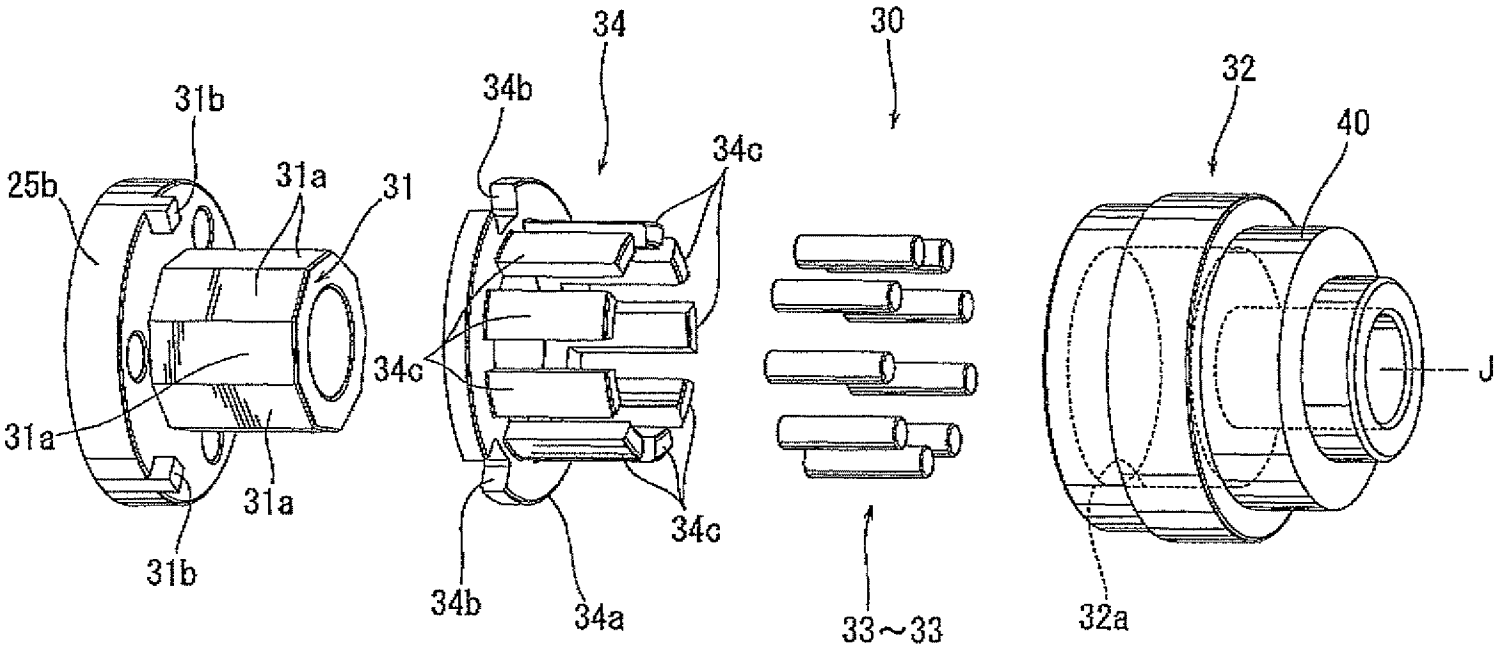
FIG. 5 is an exploded perspective view of a transmission state switching device.
Figure 6:
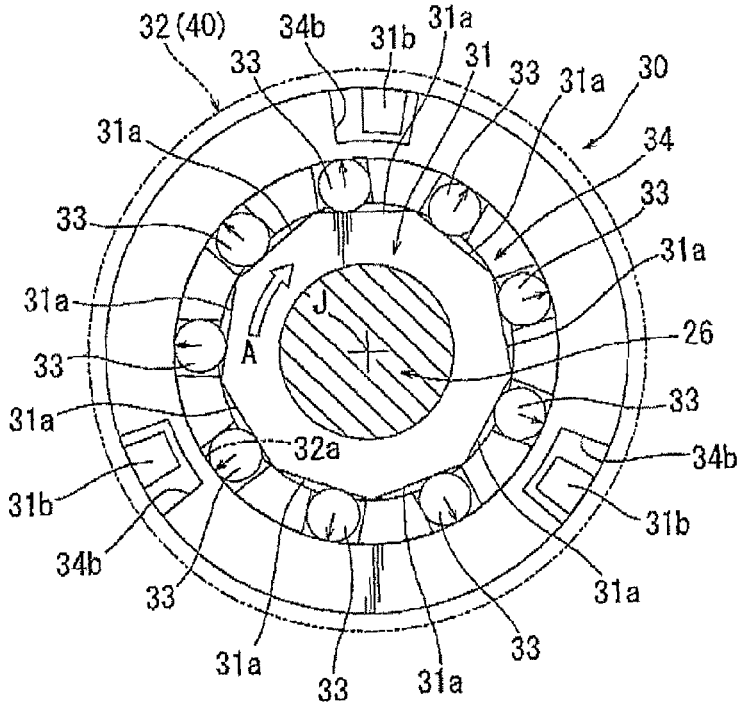
FIG. 6 is a cross-sectional view of the transmission state switching device in a power transmission state.
Figure 7:
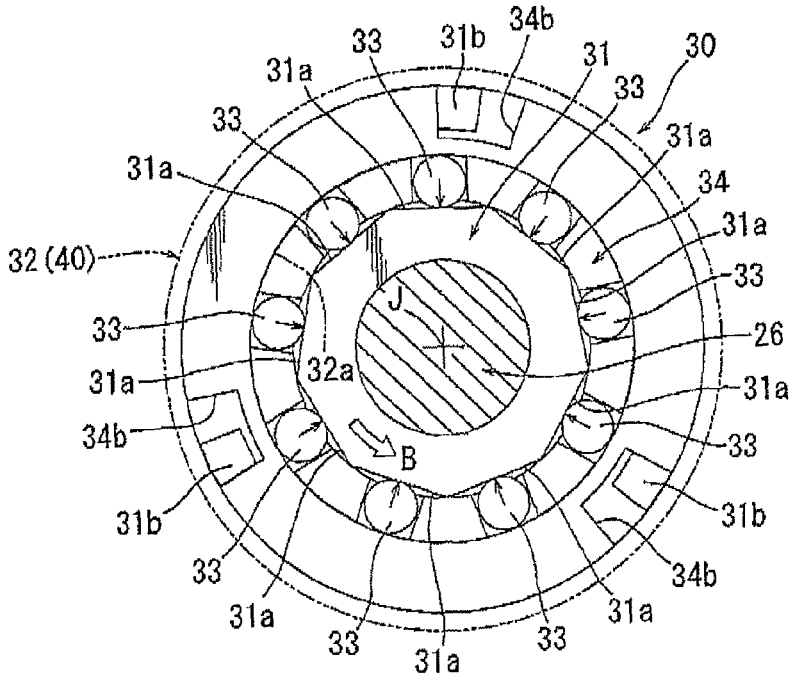
FIG. 7 is a cross-sectional view of the transmission state switching section in a transmission interruption state.

FIGS. 5 through 7 illustrate the transmission state switching device 30 in detail. The transmission state switching device 30 may include an upstream side transmission member 31, a downstream side transmission member 32 and a plurality of power transmission pins 33 provided between the upstream side transmission member 31 and the downstream side transmission member 32. The upstream side transmission member 31 may be disposed coaxially and integrally with the third-stage carrier 25*b* that is an upstream side member with respect to the power transmission path. The downstream side transmission member 32 may be formed integrally with on the drive gear 40.

The upstream side transmission member 31 may be formed as a nonagon prism shape having nine flat transmission switching surfaces 31*a* formed on the outer peripheral surface thereof. Each transmission switching surface 31*a* is in contact with one power transmission pin 33. A pin holder 34 may retain the nine power transmission pins 33 at substantially equal intervals along a circle. As shown in the drawing, the pin holder 34 is integrally provided with a total of nine support pillars 34*c* arranged along a circle. The nine support pillars 34*c* extend parallel to each other in the direction of the axis J. One power transmission pin 33 is retained between two adjacent support pillars 34*c* so as to be capable of displacement in the radial direction of the pin holder 34. Three engagement recesses 34*b* are formed in a flange portion 34*a* of the pin holder 34. The three engagement recesses 34*b* are arranged at three positions that are at equal intervals in the circumferential direction. In correspondence with the three engagement recesses 34*b*, there are provided three engagement protrusions 31*b* on the right-hand end surface of the third-stage carrier 25*b*. When the three engagement protrusions 31*b* are respectively moved into the engagement recesses 34*b*, the flange portion 34*a* may contact with the right-hand side surface of the third-stage carrier 25*b*, whereby the nine power transmission pins 33 are arranged at equal intervals in the circumferential direction on the outer peripheral side of the upstream side transmission member 31 through the intermediation of the pin holder 34.

Within a movable range of the engagement protrusions 31*b* relative to and within the engagement recesses 34*b*, the upstream side transmission member 31 is capable of relative rotation with respect to the pin holder 34. As a result of the relative rotation of the upstream side transmission member 31 with respect to the pin holder 34, each transmission switching surface 31*a* is displaced in the circumferential direction with respect to each power transmission pin 33.

A rubber ring 28 having an annular configuration may slidably contact the outer circumferential surface of the third-stage carrier 25*b*. The rubber ring 28 may be fixed in position along the inner circumferential surface of the gear housing 20*a*. As a result of the sliding contact of the rubber ring 28 with the circumferential surface of the third-stage carrier 25*b*, an appropriate frictional resistance against rotation in the rotational direction of the third-stage carrier 25*b* may be produced. Due to this appropriate resistance, the rotational position of the third-stage carrier 25*b* is maintained when the electric motor 10 is at rest (i.e., in the rotation-free state).

Bach power transmission pin 33 may be retained between the transmission switching surface 31*a* of the upstream side transmission member 31 and the inner circumferential surface (power transmission surface 32*a*) of the downstream side transmission member 32. Thus, when each transmission switching surface 31*a* is displaced in the circumferential direction with respect to each power transmission pin 33 through the relative rotation of the upstream side transmission member 31 with respect to the pin holder 34, the distance between the power transmission surface 32*a* of the downstream side transmission member 32 and each transmission switching surface 31*a* of the upstream side transmission member 31 may be changed.

As the upstream side transmission member 31 makes relative displacement with respect to the pin holder 34 in the normal rotational direction (clockwise as seen in FIG. 6) as indicated by outline arrow A in FIG. 6 by the on-operation of the switch lever 5*a*, the distance between the power transmission surface 32*a* of the downstream side transmission member 32 and each transmission switching surface 31*a* of the upstream side transmission member 31 may be reduced with respect to each power transmission pin 33. As the distance between the surfaces 32*a* and 31*a* is reduced, the power transmission pins 33 may be clamped between the surfaces 32*a* and 31*a* so as to be engaged with (wedged against) the surfaces 32*a* and 31*a*, whereby a power transmission state may be achieved to transmit the normal rotation of the upstream side transmission member 31 to the downstream side transmission member 32. As shown in FIG. 6, at this stage, the engagement protrusions 31*b* are not in contact with the end portions of the engagement recesses 34*b*, so that the rotational power of the upstream side transmission member 31 can be reliably transmitted to the downstream side transmission member 32 by way of engagement of the power transmission pins 33.

In contrast, when the switch lever 5*a* is operated to be switched off, the electric motor 10 may be stopped after being slightly rotated in the reverse direction. As shown in FIG. 7, as the electric motor 10 is slightly rotated in the reverse direction, the upstream side transmission member 31 makes relative displacement in the reverse direction (in the counterclockwise direction as viewed in FIG. 7) indicated by outline arrow B with respect to the pin holder 34, and the distance between the power transmission surface 32*a* and the transmission switching surface 31*a* becomes maximum with respect to each power transmission pin 33. When the distance between the surfaces 32*a* and 31*a* has become maximum, the clamping state of the power transmission pins 33 between the surfaces 32*a* and 31*a* may be released, so that a transmission interruption state may be achieved to interrupt transmission of power from the upstream side transmission member 31 to the downstream side transmission member 32. As shown in FIG. 7, at this stage, the engagement protrusions 31*b* may contact with the end portions of the engagement recesses 34*b*, so that the relative rotation in the reverse direction of the upstream side transmission member 31 with respect to the pin holder 34 can be restricted. In this state, each power transmission pin 33 is situated at the center of the transmission switching surface 31*a*, so that the distance between the transmission switching surface 31*a* and the power transmission surface 32*a* may be a maximum distance. Thus, the clamping state of the power transmission pins 33 is kept released, so that the transmission interruption state is maintained. This transmission interruption state of the transmission state switching device 30 may be maintained even after the electric motor 10 has been stopped.

As described above, the rubber ring 28 is in sliding contact with the circumferential surface of the third-stage carrier 25*b* to maintain the rotational position thereof. Therefore, the rotation stop position of the third-stage carrier 25*b* and eventually that of the upstream side transmission member 31 may be maintained when the electric motor 10 has been stopped. This may also help to reliably maintain the transmission interruption state when the electric motor 10 has been stopped.

In this way, as the upstream side transmission member 31 makes relative rotation in the normal direction indicated by the outline arrow A in FIG. 6 through the normal rotation of the electric motor 10, the transmission state switching device 30 may be brought to the power transmission state shown in FIG. 6, and the rotational power is transmitted to the downstream side transmission member 32. As the upstream side transmission member 31 makes relative rotation to the reverse direction as indicated by the outline arrow B in FIG. 7 through slight rotation in the reverse direction of the electric motor 10 as a result of the switching-off of the switch lever 5*a*, the transmission state switching device 30 is brought to the transmission interruption state in which the transmission of power between the upstream side transmission member 31 and the downstream side transmission member 32 is interrupted. In this transmission interruption state, the push rod 6 may be separated from the rotational power transmission path of the electric motor 10 so as to be movable independently. Therefore, the push rod 6 may be brought to a free-movement-possible state in which it can be advanced by pushing the grip 6*b* manually forwards while grasping the grip 6*b* and in which, conversely, it can be retreated by pulling the grip 6*b* backwards.

The downstream side transmission member 32 is rotatably supported by the gear housing 20*a* via bearings 35 and 36. This downstream side transmission member 32 is also rotatable about the axis J. The drive gear 40 is provided on the outer circumferential surface of the downstream side transmission member 32. As shown in FIG. 4, the drive gear 40 is situated substantially at the center in the right and left widthwise direction of the main body portion 2. Thus, the push rod 6 having the rack portion 6*c* in mesh with the drive gear 40 is arranged so as to be capable of advancing and retreating in the forward and rearward directions across substantially the center in the right and left widthwise direction of the main body portion 2.

In the transmission interruption state when the electric motor 10 is at rest, the push rod 6 is in the free-movement-possible state. In this free-movement-possible state, it is possible to restore the push rod 6 backwards by gasping its grip 6*b* and pulling it manually backwards. When the push rod 6 has been retreated by pulling it backwards, it is possible to place the cartridge 3 on the cartridge setting portion 4. After the cartridge 3 has been placed on the cartridge setting portion 4, the push rod 6 in the free-movement-possible state is manually pushed forwards, and the push plate 6*a* thereof is brought into contact with the extrusion surface 3*b* of the cartridge 3. In this way, the setting of the cartridge 3 is completed.

When the user pulls the switch lever 5*a* with a fingertip of his or her band grasping the handle portion 5, the electric motor 10 is started to rotate in the normal direction. The rotation of the electric motor 10 is reduced by the belt reduction mechanism formed by the drive pulley 11 and the driven pulley 22 between which the transmission belt 12 extends, and is then input to the reduction gear mechanism 20 to be further reduced. By the reduction gear mechanism 20, the rotation of the electric motor 10 is further reduced by the first through third-stage planetary gear trains 23 through 25. The rotation reduced by the first-stage and second-stage planetary gear trains 23 and 24 arranged on the right-hand side portion of the main body portion 2 is input to the third-stage planetary gear train 25 arranged on the left-hand side portion of the main body portion 2 via the drive shaft 26. After being reduced by the third-stage planetary gear train 25, the rotational power is input to the transmission state switching device 30 arranged substantially at the center in the right and left widthwise direction of the main body portion 2.

As long as the electric motor 10 rotates in the normal direction, a power transmission state is achieved by the transmission state switching device 30, in which the power transmission pins 33 are clamped and wedged between the transmission switching surfaces 31*a* of the upstream side transmission member 31 and the power transmission surface 32*a* of the downstream side transmission member 32. Due to this power transmission state, the rotational power of the electric motor 10 is output to the drive gear 40. As the drive gear 40 is rotated by the rotational power, the push rod 6 advances trough the mesh-engagement between the drive gear 40 and the rack portion 6*c*. As the push rod 6 advances, the extrusion surface 3*b* of the cartridge 3 is pushed in the dispensing direction by its push plate 6*b*, so that the caulking material contained in the cartridge 3 is dispensed from the nozzle 3*a*.

After a fixed amount of caulking material has been dispensed from the nozzle 3*a*, the user may release the pulling force of the switch lever 5*a* (i.e., performs turning-off operation), so that the electric motor 10 stops after being slightly reversed. As the electric motor 10 is reversed, the transmission state switching device 30 is switched to the transmission interruption state shown in FIG. 7 as described above. In the transmission interruption state, the push rod 6 is separated from the power transmission path of the electric motor 10, and is placed in the free-movement-possible state. When the push rod 6 is placed in the free-movement-possible state, the push rod 6 may be pushed backwards together with the extrusion surface 3*b* due to the residual pressure inside the cartridge 3, whereby it is possible to prevent so-called after-dripping from the nozzle 3*a*.

With, the caulking gun 1 of this embodiment constructed as described above, there is provided, in the power transmission path between the electric motor 10 and the push rod 6, the transmission state switching device 30 capable of switching between the power transmission state shown in FIG. 6 and the transmission interruption state shown in FIG. 7. This transmission state switching device 30 is forcibly switched to the transmission interruption state through slight reversing of the electric motor 10 as a result of the turning-off of the switch lever 5*a*.

As the transmission state switching device 30 is switched to the transmission interruption state, the push rod 6 is separated from the power transmission path of the electric motor 10, and is placed in the free-movement-possible state. When the push rod 6 is placed in the free-movement-possible state, the push rod 6 is retreated by the residual pressure inside the cartridge 3, whereby the residual pressure inside the cartridge 3 is released, making it possible to prevent after-dripping.

In this way, through the turning-off of the switch lever 5*a*, the electric motor 10 is slightly reversed, and the transmission state switching device 30 is switched to the transmission interruption state, thereby placing the push rod 6 in the free-movement-possible state. As a result, the push rod 6 is pushed back by the residual pressure of the cartridge 3, whereby the residual pressure inside the cartridge 3 is released. Thus, no gap may be generated between the extrusion surface 3*b* of the cartridge 3 and the push plate 6*a* of the push rod 6, so that over-restoration in which the push rod is forcibly retreated through the reverse rotation of the electric motor as in the conventional construction may not occur. Therefore, time lag corresponding to the gap in the conventional construction at the time of the next extrusion may not be produced.

The relative rotational angle in the reverse direction of the upstream side transmission member 31 with respect to the pin bolder 34 may be restricted to a fixed angle through interference of the engagement protrusions 31*b* with the engagement recesses 34*b* as shown in FIG. 7. Thus, the reverse rotation of the electric motor 10 may not cause clamping of the power transmission pins 33 of the transmission state switching device 30, so that the upstream side transmission member 31 and the downstream side transmission member 32 may not be rotated together in the reverse direction. Thus, the rotation in the reverse direction of the electric motor 10 is not transmitted to the downstream side transmission member 32. In this way, the electric motor 10 rotates idle in the reverse direction after the transmission state switching device 30 has been switched to the transmission interruption state. No manual operation is necessary for the switching operation of the transmission state switching device 30.

Accordingly, independently of the time of reversing the rotation of the electric motor 10, the push rod 6 may not retreat by a distance more than necessary for releasing the residual pressure (over-restoration in the related-art technique). Therefore, the push plate 6*a* may be held in contact with the extrusion surface 3*b* of the cartridge 3, so that time lag corresponding to the gap may not occur at the time of the next extrusion operation.

In this way, the push rod 6 is not directly retreated by the rotation of the electric motor 10 as in the related art but is retreated together with the extrusion surface 3*b* due to the residual pressure in the cartridge 3 in the free-movement-possible state, which is realized by placing the transmission state switching device 30 in the transmission interruption state. No gap is generated between the front end of the push rod 6 (the push plate 6*a*) and the extrusion surface 3*b* of the cartridge 3. Thus, time lag corresponding to the gap as in the elated art may not be generated at the time of the next starting of the electric motor (which means a satisfactory responsiveness), and the extrusion surface 3*b* of the cartridge 3 is pressed substantially simultaneously to dispense the caulking material, so that it is possible to improve the caulking gun 1 in terms of usability, and to realize a quick caulking material applying operation.

Further, in the embodiment described above, the belt transmission type reduction mechanism is provided between the output shaft 10*a* of the electric motor 10 and the reduction gear mechanism 20. As compared with the gear mesh-engagement type reduction mechanism, the belt transmission type reduction mechanism can provide a higher reduction ratio without involving an increase in the distance between the output shaft 10*a* of the electric motor 10 and the drive shaft 26, so that it is possible to achieve a reduction in the size, mainly in the forward and rearward direction, of the main body portion 2 and eventually the size of the caulking gun 1.

The above-described embodiment may be modified in various ways. For example, while in the above embodiment the rotation of the electric motor 10 is reduced by the belt transmission mechanism in which the transmission belt 12 extends between the drive pulley 11 and the driven pulley 22, the reduction may be effected through mesh-engagement of gears.

Further, while in the above embodiment three stages of planetary gear trains 23 through 25 are provided in the reduction gear mechanism 20, the reduction may also be effected by one or two stages of planetary gear trains; or, conversely, by four or more stages of planetary gear trains. In this case, it is possible to effect the reduction by providing one or two stages of planetary gear trains respectively on both sides of the main body portion 2.

Further, while in the above-described embodiment nine power transmission pins 33 are provided in the transmission state switching device 30, it is also possible to attain the same effect by providing the power transmission pins in a number not more than eight or in a number not less than ten.

Further, while in the above-described embodiment the electric motor 10 (the output shaft 10*a* thereof) is arranged parallel to the drive shaft 26, even in a case where it is arranged orthogonal to the drive shaft or arranged otherwise, it is possible to attain the same effect by using the above-described transmission state switching device 30.

Further, while in the above-described embodiment the engagement (wedging) of the transmission pins 33 is released by slightly reversing the electric motor 10 after the turning-off of the switch lever 5*a* to cause the upstream side transmission member 31 to make relative rotation in the direction indicated by the outline arrow B in FIG. 7 with respect to the pin holder 34. However, it is also possible to apply an external force to the pin holder 34 for releasing the engagement of the transmission pins 33 by providing, for example, between the upstream side transmission member 31 and the pin holder 34, a biasing device such as a torsion spring for imparting an biasing force for causing the pin holder 34 to make relative rotation clockwise as seen in FIG. 6 with respect to the upstream side transmission member 31. In such a construction, when the electric motor 10 is stopped by turning off the switch lever 5*a* to thereby release the rotational power for the upstream side transmission member 31, the pin holder 34 may make relative rotation by a fixed angle in the same direction as that indicated by the outline arrow A in FIG. 6 with respect to the upstream side transmission member 31 due to the above-mentioned biasing force to thereby release the engagement of the transmission pins 33, with the result that the transmission state switching device is switched to the power separation state shown in FIG. 7. In this way, by using the biasing device, it is no longer necessary for rotating the electric motor 10 in the reverse direction after the turning-off of the switch lever 5*a*, In addition, no manual operation is necessary for the switching operation of the transmission state switching device 30.

Also in the case in which the above biasing device is employed, the relative rotation angle in the engaging releasing direction in which the engagement of the pin holder 34 with the upstream side transmission member 31 is released, is restricted to a fixed angle through interference of the engagement protrusions 31*b* with the engagement recesses 34*b* as in the above-described embodiment.

Figure 8:
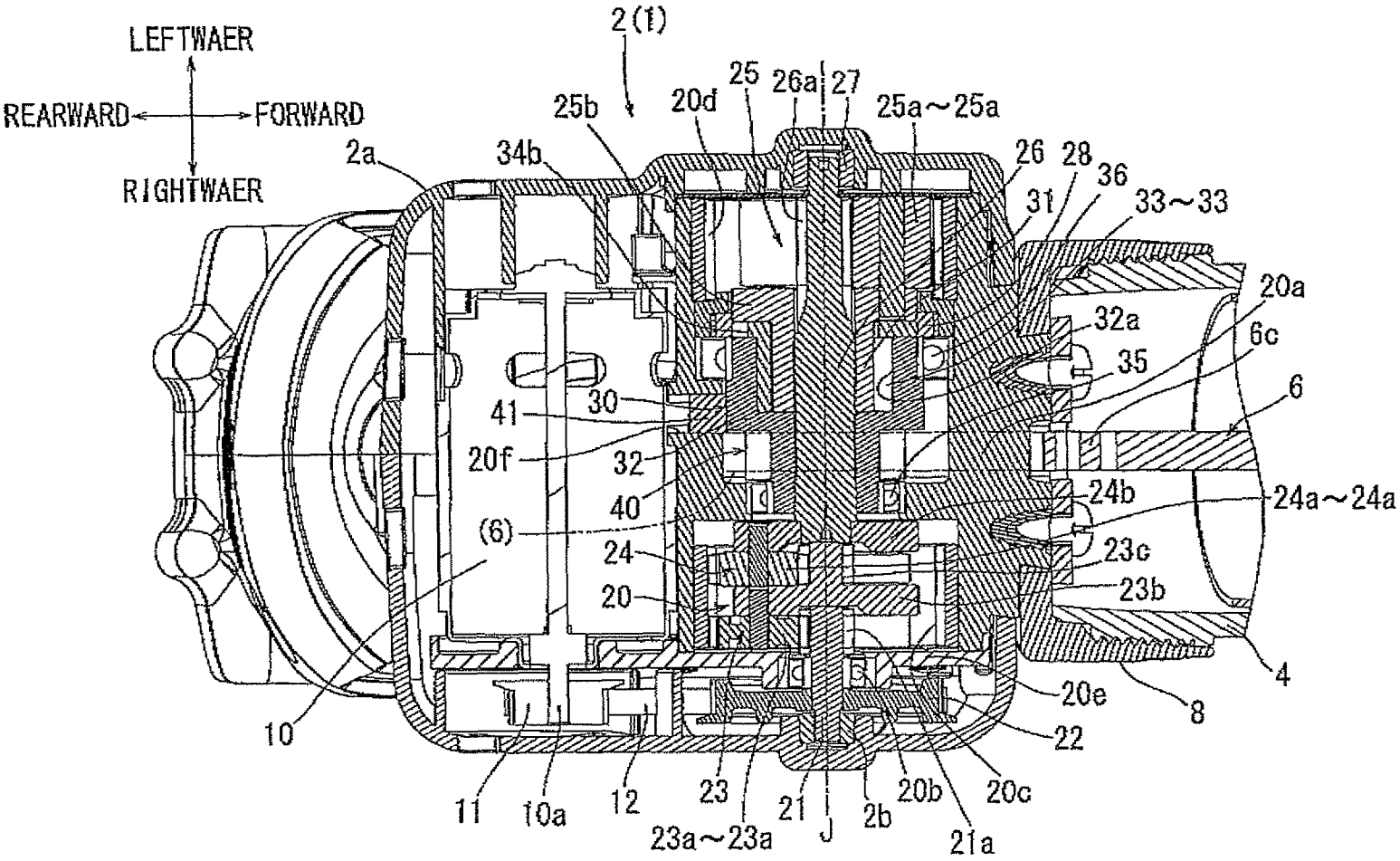
FIG. 8 is a cross-sectional view similar to FIG. 4 but showing a drive unit of a caulking gun according to an alternative embodiment.
Figure 9:
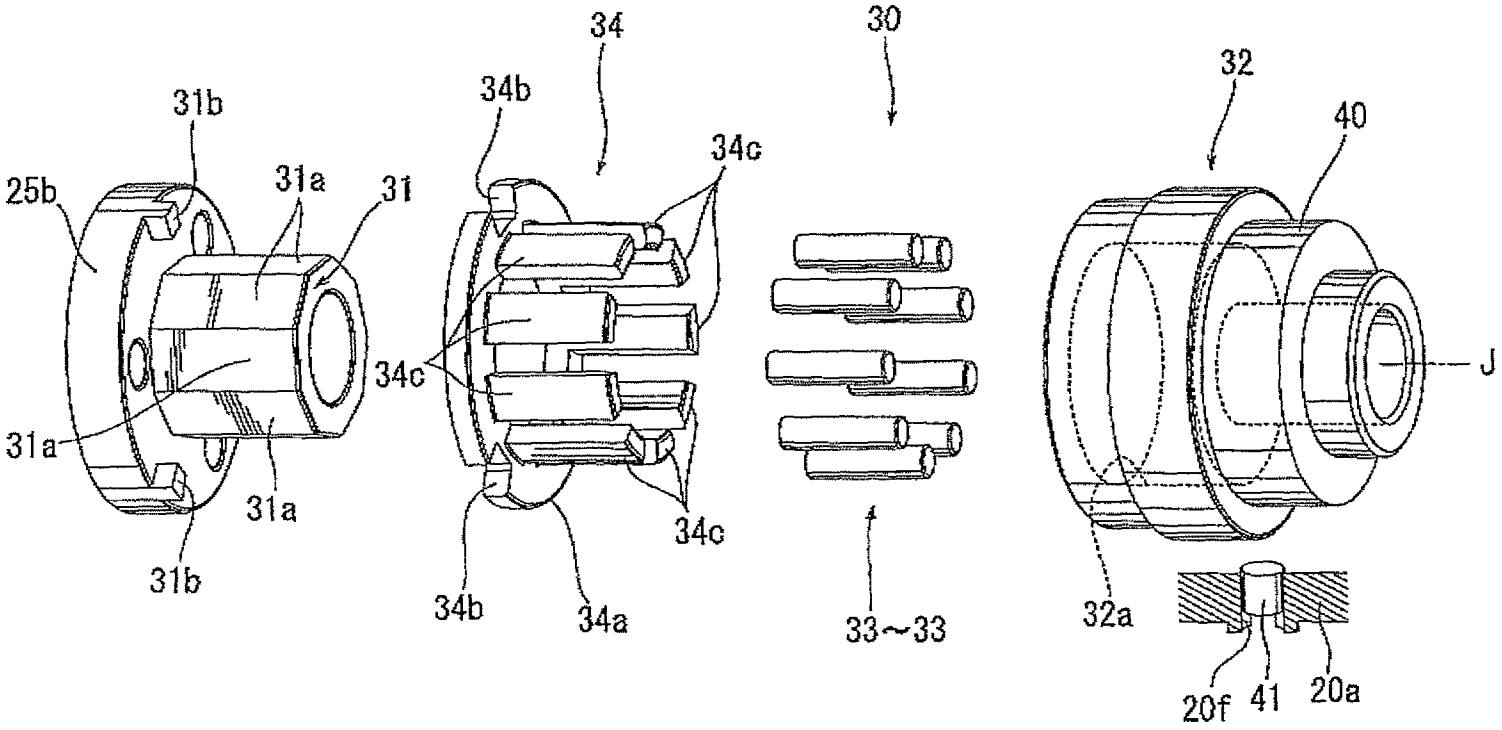
FIG. 9 is an exploded perspective view of a transmission state switching device according to the alternative embodiment.

Further, although the push rod 6 is free to move when the power transmission portion 30 is in the transmission interruption state, it may be possible to apply a resistance force against movement of the push rod 6. In a caulking gun according to an alternative embodiment shown in FIGS. 8 and 9, a magnet 41 is provided for applying a rotational resistance force to the downstream side transmission member 32 and eventually applying a movement resistance force to the push rod 6. The caulking gun according to the alternative embodiment shown in FIGS. 8 and 9 is different from the caulking gun 1 of above embodiment in that the magnet 41 is provided and that a retainer hole 20*f* for retaining the magnet 41 is formed in the gear housing 20*a*. In other respect, the construction is the same as the caulking gun 1 of the above embodiment. Therefore, in FIGS. 8 and 9, like members are given the same reference numerals as the embodiment shown in FIGS. 1 to 7 and the description of these members will not be repeated.

As described in connection with the above embodiment, when the transmission state switching device 30 is switched to the transmission interruption state, the push rod 6 may be separated from the power transmission path of the electric motor 10 so as to be capable of being freely moved. In the embodiment shown in FIGS. 8 and 9, a fixed resistance force may be applied to the push rod 6 against the free movement of the push rod 6.

More specifically, the magnet 41 may be located at a position laterally outer side of the downstream side transmission member 32. The magnet 41 may be a permanent magnet having a cylindrical rod-like shape. The magnet 41 may be press-fitted into the retainer hole 20*f* formed in the gear housing 20*a* so as to be retained therein. Accidental removal of the magnet 41 from the retainer hole 20*f* may be prevented, for example, by a part of the body housing 2*a* that may serve as a closure member for the retainer hole 20*f*. Preferably, the magnet 41 may be retained at a position spaced from the outer circumferential surface of the downstream side transmission member 32 by a small gap. The downstream side transmission member 32 may be made of magnetically attractable metal, such as steel. Due to the magnetic attractive force of the magnet 41, an adequate rotational resistance may be applied against the rotation of the downstream side transmission member 32.

In this way, the magnet 41 may serve as a rotational resistance applying member that applies a given rotational resistance against rotation of the downstream side transmission member 32. Therefore, an adequate movement resistance may be applied to the push rod 6 even after the push rod 6 has been brought to be free to move by the operation of the transmission state switching device 30. Thus, although the push rod 6 is separated from the power transmission path of the electric motor 10 so as to be free to move (for example, by the manual operation by the user), the adequate movement resistance force may be applied indirectly to the push rod 6 by the magnet 41. The movement resistance force may prevent the push rod 6 from accidentally moving downward by the gravity force, for example, when the user grasps the caulking gun in an upwardly oriented position with the cartridge setting portion 4 oriented upward. It may be also possible to prevent the push rod 6 from accidentally retracting by the inertia force that may be produced due to vibrations or the like applied to the caulking gun. Therefore, even though the push rod 6 is free to move by the manual operation, it may be possible to reliably hold the push rod 6 in a state where its push plate 6*a* is in contact with the extrusion surface 3*b* of the cartridge 3. As a result, it is possible to further reliably eliminate potential time lag of movement of the push rod 6 at the time of the next extrusion.

Further, in this alternative embodiment, the magnet 41 is located at a position laterally outer side of the outer circumferential surface of the downstream side transmission member 32 with which the drive gear 40 for meshing with the rack 6*c* of the push rod 6 is integrally formed. In other words, the resistance against movement of the push rod 6 is not directly applied to the push rod 6 but is applied to a rotary member that rotates with the free movement of the push rod 6.

In comparison with the arrangement where a resistance against movement is directly applied to the push rod 6, a smaller resistance force against rotation of the rotary member may produce an adequate resistance force against movement of the push rod 6. Hence, it is possible to use a simple and small element (magnet 41 in this embodiment) as a rotational resistance applying member. As a result, the caulking gun having a rotational resistance applying device can be configured to have a compact construction.

Further, the magnet 41 as the rotational resistance applying member is located on the lateral side of the downstream side transmission member 32 (i.e., the rotary member), it is possible to easily replace the magnet 41 with another one. By replacing the magnet 41 with another magnet that can apply a different resistance force against rotation of the rotary member, it is possible to set a movement resistance force best suited to the push rod 6 used in the caulking gun.

Furthermore, in this embodiment, the resistance force is not directly applied to the push rod 6 from a lateral side, for example, by using a biasing member. Instead, the resistance force is applied to the rotary member that is a separate member from the push rod 6. Therefore, the resistance force may not cause an undesirable shifting movement of the push rod 6 in the lateral direction. Hence, it is possible to avoid degradation in the durability of the caulking gun.

The above alternative embodiment may be further modified. For example, although the magnet 41 is attached to the gear housing 20, the magnet 41 may be attached to any other portion around the downstream side transmission member 32 (i.e., the rotary member) as long as it can resist against rotation of the downstream side transmission member 32 about the axis J.

Further, although the resistance force against rotation is applied to the downstream side transmission member 32 that is integrated with the drive gear 40, the resistance force may be applied to the drive gear 40. In other words, it may be possible to apply the resistance force to any of rotary members in the power transmission path, which may rotate with the movement of the push rod 6.

Further although the magnet 41 is located to be opposed to the outer circumferential surface of the downstream side transmission member 32 (i.e., the rotary member), the magnet 41 may be located to be opposed to a side surface of the downstream side transmission member 32 in the axial direction. In addition, the magnet 41 may be attached to the downstream side transmission member 32 in place of the gear housing 20*a*. It may be also possible to provide two or more magnets 41.

Further, the magnet 41 may be replaced with any other rotational resistance applying member, such as a rubber ring slidably contacting with the entire circumference of the rotary member, a resilient member such as a rubber strip and a spring, or a fabric such as a cloth and a felt material frictionally contacting the circumferential surface or the side surface of the rotary member for applying a frictional resistance against rotation.

What is claimed is:

1. An electric caulking gun comprising:

a cartridge setting portion to which a cartridge containing a caulking material can be set;

an electric motor;

a push rod driven by the electric motor via a power transmission path and configured to be pressed against the cartridge set at the cartridge setting portion to cause the caulking material to be dispensed from the cartridge; and a transmission state switching device provided in the power transmission path and configured to switch between a power transmission state in which the power transmission path is connected to transmit the power of the electric motor to the push rod, and a transmission interruption state in which the power transmission path is interrupted to permit the push rod to make a free movement independently of the rotation of the electric motor;

wherein the transmission state switching device comprises:

an upstream side transmission member provided on an upstream side in the power transmission path and having an outer circumferential surface with a plurality of flat transmission switching surfaces;

a downstream side transmission member provided on a downstream side in the power transmission path and having an inner circumferential surface with a circular power transmission surface; and a plurality of power transmission pins each provided between each flat transmission switching surface and the circular power transmission surface;

wherein a distance between the power transmission surface and each transmission switching surface changes through relative displacement in a rotational direction of the upstream side transmission member with respect to the downstream side transmission member to switch between the power transmission state, in which each power transmission pin is clamped between the power transmission surface and each transmission switching surface, and the transmission interruption state in which the clamping of each power transmission pin is released to interrupt the power transmission path;

wherein when the rotation of the electric motor is reversed, the transmission state switching device is switched to the transmission interruption state to release the clamping of each power transmission pin, so that the reverse rotation of the electric motor is interrupted by the transmission state switching device;

wherein the electric caulking gun further includes a pin holder having a plurality of pillar portions for holding the power transmission pins such that each power transmission pin can move between the power transmission surface and each transmission switching surface in a radial direction of the pin holder; and wherein the pin holder is rotatable relative to the upstream side transmission member within a predetermined range.

2. The electric caulking gun according to claim 1, wherein the transmission state switching device switches from the power transmission state to the transmission interruption state when the rotation of the electric motor is reversed.

3. The electric caulking gun according to claim 1, further comprising a reduction mechanism provided in the power transmission path on the upstream side of the transmission state switching device.

4. The electric caulking gun according to claim 1, wherein:

the power transmission path includes a rotary member rotatable with the movement of the push rod when the power transmission state switch device is in the transmission interruption state; and the caulking gun further includes a rotational resistance applying device configured to apply a rotational resistance force to the rotary member.

5. The electric caulking gun according to claim 1, wherein:

the upstream side transmission member includes a first contact surface;

the pin holder includes a second contact surface; and the first contact surface and the second contact surface are configured to contact with each other in the transmission interruption state to prevent the upstream side transmission member from rotating in the reverse direction relative to the pin holder.

6. The electric caulking gun according to claim 5, wherein:

the upstream side transmission member further includes an engage recess formed in the upstream side transmission member and extends in a circumferential direction thereof;

the engaging recess includes opposite wall surfaces disposed on opposite sides in the circumferential direction of the engaging recess;

the pin holder includes an engaging protrusion inserted into the engaging recess so as to be movable within a predetermined distance in the circumferential direction within the engaging recess;

the engaging protrusion includes opposite side surfaces disposed on opposite sides in the circumferential direction;

the first contact surface is one of the opposite wall surfaces of the engaging recess; and the second contact surface is one of opposite side surfaces of the engaging protrusion opposing to one of the opposite wall surfaces in the circumferential direction.

7. The electric caulking gun according to claim 1, wherein the transmission state switching device is automatically switched to the transmission interruption state in response to the reverse rotation of the upstream side transmission member.

8. An electric caulking gun comprising:

a cartridge setting portion to which a cartridge containing a caulking material can be set;

an electric motor;

a push rod driven by the electric motor via a power transmission path and configured to be pressed against the cartridge set at the cartridge setting portion to cause the caulking material to be dispensed from the cartridge; and a transmission state switching device provided in the power transmission path and configured to switch between a power transmission state in which the power transmission path is connected to transmit the power of the electric motor to the push rod, and a transmission interruption state in which the power transmission path is interrupted to permit the push rod to make a free movement independently of the rotation of the electric motor, wherein:

the power transmission path includes a rotary member rotatable with the movement of the push rod when the power transmission state switch device is in the transmission interruption state;

the transmission state switching device comprises:

an upstream side transmission member provided on an upstream side in the power transmission path and having an outer circumferential surface with a plurality of flat transmission switching surfaces;

a downstream side transmission member provided on a downstream side in the power transmission path and having an inner circumferential surface with a circular power transmission surface; and a plurality of power transmission pins each provided between each flat transmission switching surface and the circular power transmission surface;

wherein a distance between the power transmission surface and each transmission switching surface changes through relative displacement in a rotational direction of the upstream side transmission member with respect to the downstream side transmission member to switch between the power transmission state, in which each power transmission pin is clamped between the power transmission surface and each transmission switching surface, and the transmission interruption state in which the clamping of each power transmission pin is released to interrupt the power transmission path;

wherein the rotary member is the downstream side transmission member;

wherein the caulking gun further includes:

a rotational resistance applying device configured to apply a rotational resistance force to the downstream side transmission member; and a housing for receiving the downstream side transmission member therein; and wherein the rotational resistance applying device is a magnet attached to the housing and positioned to be opposed to an outer circumferential surface of the downstream side transmission member.

9. An electric caulking gun comprising:

a cartridge setting portion to which a cartridge containing a caulking material can be set;

an electric motor;

a push rod driven by the electric motor via a power transmission path and configured to be pressed against the cartridge set at the cartridge setting portion to cause the caulking material to be dispensed from the cartridge;

a transmission state switching device provided in the power transmission path and configured to switch between a power transmission state in which the power transmission path is connected to transmit the power of the electric motor to the push rod, and a transmission interruption state in which the power transmission path is interrupted to permit the push rod to make a free movement independently of the rotation of the electric motor;

wherein the power transmission path includes a rotary member rotatable with the movement of the push rod when the power transmission state switch device is in the transmission interruption state; and a rotational resistance applying device configured to apply a rotational resistance force to the rotary member;

wherein the transmission path includes a drive gear coupled to the electric motor, and a rack provided on the push rod and meshing with the drive gear;

wherein the rotational member is the drive gear; and wherein the rotational resistance applying device is a rubber ring.

* * * * *